United States Patent [19]

Kadija

[11] 4,184,939

[45] Jan. 22, 1980

[54] DIAPHRAGMS FOR USE IN THE ELECTROLYSIS OF ALKALI METAL CHLORIDES

[75] Inventor: Igor V. Kadija, Cleveland, Tenn.

[73] Assignee: Olin Corporation, New Haven, Conn.

[21] Appl. No.: 836,636

[22] Filed: Sep. 26, 1977

[51] Int. Cl.[2] ..... C25B 13/04

[52] U.S. Cl. ..... 204/252; 204/295; 204/296; 204/98

[58] Field of Search ..... 204/295, 296, 252

[56] References Cited

U.S. PATENT DOCUMENTS

| | | | |
|---|---|---|---|
| 1,742,411 | 1/1930 | Muller | 204/295 UX |
| 3,424,659 | 1/1969 | Staal | 204/74 |
| 3,847,762 | 11/1974 | Strain | 204/98 |
| 4,032,427 | 6/1977 | Kadija | 204/283 |

FOREIGN PATENT DOCUMENTS

| | | | |
|---|---|---|---|
| 7249424 | 12/1972 | Japan | 204/296 |
| 50-26770 | 3/1975 | Japan | 204/296 |
| 245127 | 3/1927 | United Kingdom | 204/295 |

*Primary Examiner*—F. C. Edmundson

*Attorney, Agent, or Firm*—James B. Haglind; Donald F. Clements

[57] ABSTRACT

A diaphragm for use in the electrolysis of alkali metal chloride brines in electrolytic diaphragm cells is comprised of a support fabric impregnated with a non-fibrilic active component containing silica where the porous diaphragm has a permeability to alkali metal chloride brines of from about 100 to about 300 milliliters per minute per square meter of diaphragm at a head level difference in the cell of from about 0.1 to about 20 inches of the alkali metal chloride brines. The active component containing silica is employed in concentrations of from about 10 to about 75 milligrams per square centimeter of support fabric.

Suitable silica-containing materials include sand, colloidal silica, alkali metal silicates, alkaline earth metal silicates, aluminum silicates, as well as minerals such as sepiolites, meerschaums, attapulgites, montmorillonites and bentonites.

Support fabrics include, for example, felt fabrics produced from thermoplastics such as polyolefins or polyarylene sulfides.

The diaphragms are physically and chemically stable, can be easily installed in an electrolytic cell, have increased operational life and are produced from inexpensive materials.

47 Claims, 3 Drawing Figures

DIAPHRAGMS FOR USE IN THE ELECTROLYSIS OF ALKALI METAL CHLORIDES

This invention relates to diaphragm-type electrolytic cells for the electrolysis of aqueous salt solutions. More particularly, this invention relates to novel diaphragms for electrolytic diaphragm cells.

For years commercial diaphragm cells have been used for the production of chlorine and alkali metal hydroxides such as sodium hydroxide which employed a porous diaphragm of asbestos fibers. In employing asbestos diaphragms, it is thought that the effective diaphragm is a gel layer formed within the asbestos mat. This gel layer is formed by the decomposition of the asbestos fibers. In addition to undergoing chemical decomposition during operation of the cell when electrolyzing alkali metal chloride solutions, the asbestos fibers also suffer from dimensional instability as they are distorted by swelling. Porous asbestos diaphragms while satisfactorily producing chlorine and alkali metal hydroxide solutions, have limited cell life and once removed from the cell, cannot be re-used. Further asbestos has now been identified by the Environmental Protection Agency of the U.S. Government as a health hazard.

Therefore there is a need for diaphragms having increased operating life while employing materials which are durable as well as inexpensive.

It is an object of the present invention to provide a diaphragm having increased stability and a longer operational life when employed in the electrolysis of alkali metal chloride solutions.

Another object of the present invention is the use of ecologically acceptable non-polluting materials in diaphragm compositions.

Yet another object of the present invention is a diaphragm having reduced resistance to electric current.

An additional object of the present invention is a diaphragm having support materials which are chemically and physically stable during electrolysis.

A further object of the invention is the production of diaphragms having reduced costs for materials.

A still further object of the present invention is a diaphragm which can be handled easily during installation in and removal from the electrolytic cell.

These and other objects of the invention will be apparent from the following description of the invention.

Briefly, the novel porous diaphragm of the present invention for an electrolytic cell for the electrolysis of alkali metal chloride brines comprises a support fabric impregnated with a non-fibrilic active component containing silica, the porous diaphragm having a permeability to the alkali metal chloride brines of from about 100 to about 300 milliliters per minute per square meter of diaphragm at a head level difference in the cell of from about 0.1 to about 20 inches of alkali metal chloride brines.

Accompanying FIGS. 1-3 illustrate the novel diaphragm of the present invention.

Figure 1:
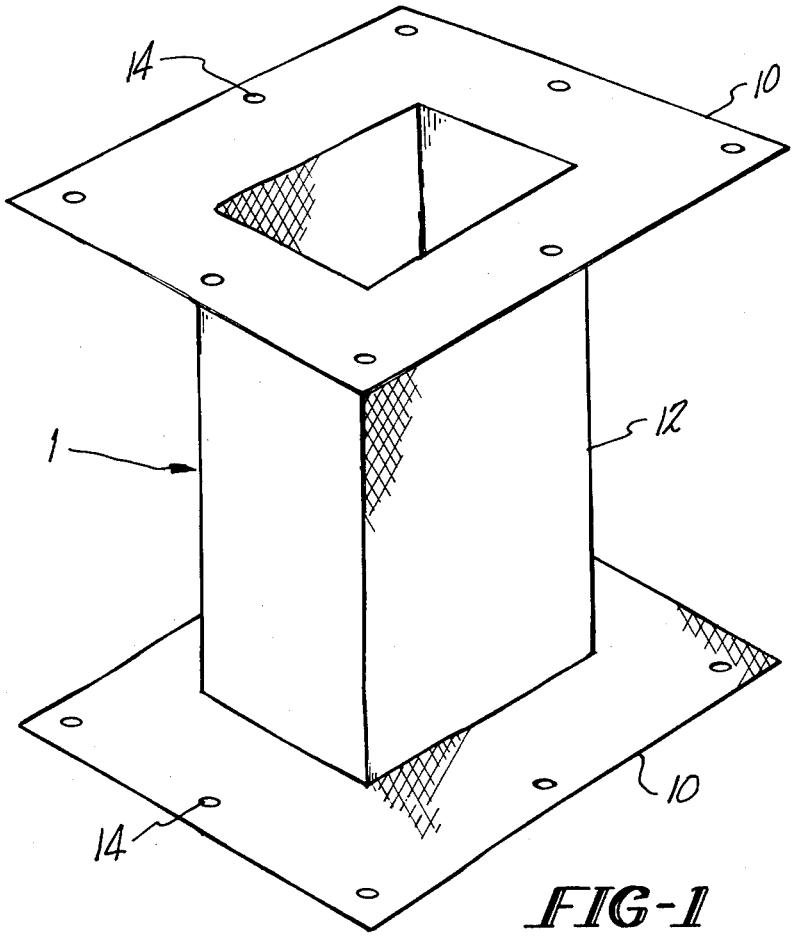
FIG. 1 illustrates a perspective view of one embodiment of the present invention.

FIG. 1 illustrates a diaphragm of the present invention suitable for covering a cathode. Diaphragm 1, comprised of fabric, has end portions 10 attached, for example, by sewing, to diaphragm body 12. Diaphragm body 12 is a hollow rectangle which is mounted on a cathode (not shown) so that it surrounds the cathode on all sides. End portions 10 have openings 14 which permit end portions 10 to be attached to the cell walls (not shown).

Figure 2:
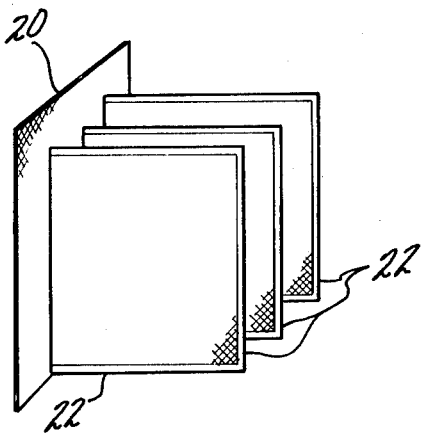
FIG. 2 shows a perspective view of one embodiment of the diaphragm of the present invention suitable for use with a plurality of electrodes.

FIG. 2 depicts a diaphragm suitable for use with a plurality of electrodes. Fabric panel 20 has fabric casings 22 attached substantially perpendicular to the plane of panel 20. Fabric casings 22 are suitably spaced apart from each other and are attached to fabric panel 20, for example, by sewing. Fabric panel 20 has openings (not shown) corresponding to the area where fabric casings 22 are attached to permit the electrodes to be inserted in fabric casings 22.

Figure 3:
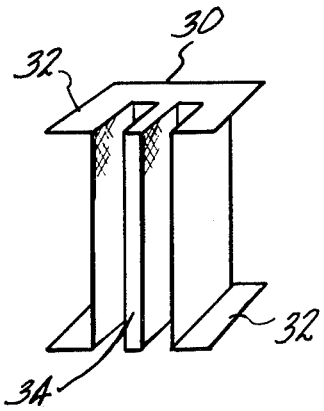
FIG. 3 depicts a perspective view of an additional embodiment of the diaphragm of the present invention for use with a plurality of electrodes.

FIG. 3 illustrates another embodiment of the diaphragm of the present invention. U-shaped fabric panel 30 has end portions 32 for attachment to the cell walls (not shown). Fabric casing 34 is attached to U-shaped fabric panel 30, for example, by sewing. An opening (not shown) at the bottom of fabric casing 34 permits the diaphragm to be installed on a vertically positioned electrode.

The porous diaphragm of the present invention has as its active ingredient, a non-fibrilic component containing silica. For the purposes of this invention, silica is equivalent to silicon dioxide. The component containing silica should be capable of undergoing hydration when in contact with the electrolytes in the cell. A large number of silica-containing materials can be used including sand, quartz, silica sand, colloidal silica, as well as chalcedony, cristobalite and tripolite. Also suitable are alkali metal silicates such as sodium silicate, potassium silicate and lithium silicate; alkaline earth metal silicates such as magnesium silicates or calcium silicates; and aluminum silicates. In addition, a number of minerals can be suitably used as the silica-containing ingredient including magnesium-containing silicates such as sepiolites, meerschaums, augites, talcs and vermiculites; magnesium-aluminum-containing silicates such as attapulgites, montmorillonites and bentonites, and alumina-containing silicates such as albites, feldspars, labradorites, microclines, nephelites, orthoclases, pyrophyllites, and sodalites, as well as natural and synthetic zeolites.

When using as the active component a silica component such as sand, quartz, silica sand, colloidal silica, chalcedony, cristobalite, tripolite and alkali metal silicates, it may be desirable to include an additive which provides improved ionic conductivity and cation exchange properties. Suitable additives include, for example, magnesia, magnesium acetate, magnesium aluminate, magnesium carbonate, magnesium chloride, magnesium hydroxide, magnesium oxide, magnesium peroxide, magnesium silicate, magnesite, periclase, dolomites, alumina, aluminum acetate, aluminum chlorate, aluminum chloride, aluminum hydroxide, aluminum oxides ($\alpha$, $\beta$ and $\gamma$), aluminum silicate, corundum, bauxites as well as lime, lithium salts such as lithium chloride and lithium nitrate inorganic phosphates such as aluminum phosphates and sodium phosphates.

The additives may be used in amounts of from about 10 to about 70 and preferably from about 20 to about 50 percent by weight of the active component containing silica.

The presence of metals other than alkali metals alkaline earth metals and aluminum can be tolerated at low concentrations. For example, the concentration of metals such as Fe, Ni, Pb, Ag as well as other heavy metals which may be present in the alkali metal chloride brines electrolyzed are preferably below one part per million. Where these metals are found in the silica-containing materials, it is preferred that their concentration be less than about 5 percent of the concentration of silicon present in the material.

Concentrations of non-metallic materials such as fluorine or ammonia as well as organic compounds should also be maintained at moderate or preferably low levels.

The degree to which the active component containing silica is hydrated is the basis for selecting suitable particle sizes of the component for those materials which are readily hydrated in the electrolyte solutions used or produced in the cell, a particle size as large as about 100 microns is satisfactory. Where the component is less easily hydrated, the particle size may be substantially reduced. For these materials, particles having a size in the range of from about 75 microns to about one micron are more suitable.

As a support material for the active component containing silica, a fabric is employed which is produced from thermoplastic materials which are chemically resistant to and dimensionally stable in the gases and electrolytes present in the electrolytic cell. The fabric support is substantially non-swelling, non-conducting and non-dissolving during operation of the electrolytic cell.

The fabric support has a thickness of from about 0.04 to about 0.33, preferably from about 0.06 to about 0.25, and more preferably from about 0.09 to about 0.18 of an inch. The fabric support is non-rigid and is sufficiently flexible to be shaped to the contour of an electrode, if desired.

Suitable fabric supports are those which can be handled easily without suffering physical damage. This includes handling before and after they have been impregnated with the active component. Suitable support fabrics can be removed from the cell following electrolysis, treated or repaired, if necessary, and replaced in the cell for further use without suffering substantial degration or damage.

Support fabrics having uniform permeability throughout the fabric are quite suitable in diaphragms of the present invention. Prior to impregnation with the active component containing silica, these support fabrics should have a permeability to gases such as air of, for example, from about 1 to about 500, and preferably from about 5 to about 100 cubic feet per minute per square foot of fabric. However, fabrics having greater or lesser air permeability may be used. Uniform permeability throughout the support fabric is not, however, required and it may be advantageous to have a greater permeability in the portion of the support fabric which, when impregnated, will be positioned closest to the anode in the electrolytic cell. Layered structures thus may be employed as support fabrics having, a first layer which when the diaphragm is installed in the cell, will be in contact with the anolyte; and a second layer which will be in contact with the catholyte. The first layer may have, for example, a thickness of from about 0.09 to about 0.187 of an inch and an air permeability of, for example, from about 100 to about 500 cubic feet per minute. The first layer, may be, for example, a net having openings which are slightly larger than the particle size of the active ingredient with which it is impregnated.

The second layer, in contact with the catholyte when installed in the cell, may, for example, have a thickness of from about 0.03 to about 0.125 of an inch and an air permeability, for example, of from about 1 to about 15 cubic feet per minute. For the purpose of using a selected size of active component containing silica, the layered support fabric can be produced by attaching, for example, a net to a felt. The net permits the particles to pass through and these are retained on the felt.

Suitable permeability values for the support fabric may be determined, for example, using American Society for Testing Materials Method D737-75, Standard Test Method for Air Permeability of Textile Fabrics.

The support fabrics may be produced in any suitable manner. Suitable forms are those which promote absorption of the active component including sponge-like fabric forms. A preferred form of support fabric is a felt fabric.

Materials which are suitable for use as support fabrics include thermoplastic materials such as polyolefins which are polymers of olefins having from about 2 to about 6 carbon atoms in the primary chain as well as their chloro- and fluoro-derivatives.

Examples include polyethylene, polypropylene, polybutylene, polypentylene, polyhexylene, polyvinyl chloride, polyvinylidene chloride, polytetrafluoroethylene, fluorinated ethylene-pyropylene (FEP), polychlorotrifluoroethylene, polyvinyl fluoride, polyvinylidene fluoride, and copolymers of ethylene-chlorotrifluoroethylene.

Preferred olefins include the chloro- and fluoro-derivatives such as polytetrafluoroethylene, fluorinated ethylene-propylene, polychlorotrifluoroethylene, polyvinyl fluoride, and polyvinylidene fluoride.

Also suitable as support materials are fabrics of polyaromatic compounds such as polyarylene compounds. Polyarylene compounds include polyphenylene, polynaphthylene and polyanthracene derivatives. For example, polyarylene sulfides such as polyphenylene sulfide or polynaphthylene sulfide. Polyarylene sulfides are well known compounds whose preparation and properties are described in the *Encyclopedia of Polymer Science and Technology,* (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

In addition, fabrics which are mixtures of fibers of polyolefins and polyarylene sulfides can be suitably used.

The support fabrics may be impregnated with the active component containing silica in any of several ways. For example, a slurry of the active component in a solution such as cell liquor, is prepared and the support fabric is impregnated by soaking in the slurry. Another method is to attach the supporting fabric to the cathode and immerse the cathode in the slurry, using suction means to draw the slurry through the support fabric.

It is not necessary to employ a solution or slurry for impregnation purposes. For example, the active component containing silica may be used to form a fluidized bed. A vacuum is employed to suck the particles into the support fabric until the desired degree of impregnation is obtained.

When impregnated, the novel diaphragm of the present invention contains from about 10 to about 75, and preferably from about 30 to about 50 milligrams per square centimeter of the active component containing silica.

Electrical resistance of the diaphragms of the present invention is controlled by the selection of the thickness of the support fabric and the level of impregnation with the active component containing silica. For example, in an electrolytic cell for the electrolysis of sodium chloride brines having an anode to cathode gap of about 0.25 inch and at a current density of $2.0 \pm 0.1$ KA/m$^2$, an average voltage coefficient of from about 0.300 to about 0.450 is obtained using a polytetrafluoroethylene felt 0.064 inch thick.

Following impregnation with the active component containing silica, the diaphragms have a permeability to alkali metal chloride brines of from about 100 to about 300, and preferably from about 150 to about 250 milliliters per minute per square meter of diaphragm at a head level difference between the anolyte and the catholyte of from about 0.1 to about 20 inches of brine.

In order to provide similar brine permeability rates, deposited asbestos fiber diaphragms require a greater thickness which results in higher electrical resistance as indicated by larger voltage coefficients at comparable operating conditions. The novel diaphragms of the present invention are thus more energy efficient than deposited asbestos diaphragms and provide reduced power costs.

The novel diaphragms of the present invention have handling properties which far exceed those of, for example, asbestos. The supported diaphragms can be removed from the cell, washed or treated to restore flowability, and replaced in the cell without physical damage. During operation of the cell, the novel diaphragms remain dimensionally stable. The support fabrics are not swelled, dissolved or deteriorated by interaction with the elecrolyte, or the active component containing silica or the cell products produced.

Electrolytic cells in which the diaphragms of the present invention may be used are those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode assembly containing a plurality of foraminous metal anodes, a cathode assembly having a plurality of foraminous metal cathodes with the novel diaphragm separating the anodes from the cathodes. Suitable electrolytic cells include, for example, those types illustrated by U.S. Pat. Nos. 1,862,244; 2,370,087; 2,987,463; 3,247,090; 3,477,938; 3,493,487; 3,617,461; and 3,642,604.

When employed in electrolytic cells, the diaphragms of the present invention are sufficiently flexible so that they may be mounted on or supported by an electrode such as a cathode.

During electrolysis or when in contact with the catholyte liquor produced in the cell, the active component containing silica produces a gel-like formation which is permeable to alkali metal ions. While the gel-like formations may be produced throughout the diaphragm, they are normally produced within the support fabric in the portion which is adjacent to the anolyte side. The extent of gel formation within the support fabric varies, for example, with the thickness of the support fabric and the concentration of alkali metal hydroxide in the catholyte liquor. Preferred diaphragms are those which have a gel-free portion in contact with the catholyte having a thickness of from about 0.03 to about 0.06 of an inch. Gel formation is believed to occur during hydration of the active component containing silica. The gel is believed to be soluble in the catholyte liquor and it is desirable that the rate of dissolution be controlled to maintain a suitable equilibrium between gel formation and dissolution for efficient operation of the cell. Introduction of cations such as Mg, Al, and Ca into the gel is believed to be one way of increasing the stability of the gel and thus reduce its rate of dissolution. Another way appears to be the selection of suitable particle sizes for the active component containing silica. Efficient cell operation is attained by controlling the equilibrium sufficiently to produce a caustic liquor containing silica in amounts of from about 10 to about 150 parts per million. This may be obtained by periodically adding the active component containing silica to the brine in suitable amounts. Alkali metal chloride brines used in the electrolytic process normally contain concentrations of silica of from about 10 to about 30 parts per million and thus the brine may supply sufficient silica to maintain the equilibrium and supplemental addition of silica may not be necessary.

The porous diaphragms of the present invention are illustrated by the following examples without any intention of being limited thereby.

EXAMPLE 1

Sepiolite, having particle sizes in the range between 44 microns and less than 1 micron, was added to sodiumchloride brine having a concentration of 295–305 grams per liter of NaCl. The sepiolite was dispersed in the brine using a blender until the brine contained about 5 percent by volume of sepiolite. Analysis of the sepiolite indicated oxides of the following elements were present as percent by weight: Si 79.1; Mg 9.3; K 4.8; Ca 4.8; Al 1.4 and Fe 1.4.

A section of polytetrafluoroethylene felt 0.048 inch thick, in the form shown in FIG. 1 was washed in a caustic soda solution containing 15–20 percent NaOH and at a temperature of 30° C. for about 24 hours to remove residues and improve wettability. The felt was then fitted on a steel mesh cathode. The felt had an air permeability in the range of from about 20 to about 70 cubic feet per minute per square foot. The felt-covered cathode was immersed in the brine containing sepiolite and a vacuum applied to impregnate the felt with the dispersion until a vacuum of 23 to 27 inches was reached. The vacuum was shut off and the procedure repeated three times.

The impregnated, felt-covered cathode was installed in an electrolytic cell employing a ruthenium oxide coated titanium mesh anode and sodium chloride brine at a pH of 12, a concentration of $300 \pm 5$ grams of NaCl per liter and a temperature of 90° C. Current was passed through the brine at a density of 2.0 kiloamps per square meter of anode surface. The initial brine head level was 0.5 to 1 inch greater in the anode compartment than in the cathode compartment. The permeability of the impregnated diaphragm was found to be in the range of from about 200 to about 250 milliliters per square meter of diaphragm by measuring the rate of catholyte liquor produced. After about six days of cell operation, the premixed dispersion of sepiolite in brine was added to the anolyte. The amount added corresponded to about 3 percent of the volume of the anolyte compartment of the cell, the addition being made without interruption of the electrolysis process. After a period of six weeks, the cell voltage began to increase rapidly and current efficiency was reduced. While maintaining the cell in operation, a 5 percent HCl solution was fed to the anolyte compartment and the catholyte liquor was diluted with cold water. Cell performance after treatment of the anolyte and the catholyte was restored to that found earlier, as shown by the results in Table I below.

The catholyte liquor produced had a sodium chloride concentration in the range of 130 to 170 grams per liter. During 10 days of cell operation, the cell voltage was in the range of 2.90–3.08 volts while producing a catholyte liquor having a concentration of 108 to 128 grams per liter of NaOH at a cathode current efficiency of 88–92 percent.

TABLE I

| Days of Operation | Anolyte Head Level (inches) | Conc. NaOH (GPL) | Cell Voltage (v) | Current Efficiency (%) | Power Consumption (KWH/T $Cl_2$) |
|---|---|---|---|---|---|
| 3 | 4.0 | 128 | 2.86 | 72 | 2720 |
| 6 | 4.5 | 129 | 2.85 | 72 | 2720 |
| 8 | 7.2 | 136.8 | 2.95 | 86 | 2350 |
| 10 | 7.8 | 136 | 2.96 | 85 | 2385 |
| 14 | 7.9 | 140 | 3.00 | 87 | 2360 |
| 18 | 8.0 | 132 | 3.02 | 93 | 2224 |
| 33 | 7.2 | 131.2 | 3.05 | 93 | 2246 |
| 35 | 9.3 | 144.8 | 3.02 | 86 | 2405 |
| 42 | 8.0 | 158.4 | 3.02 | 88 | 2351 |
| 44 | 10.4 | 140.0 | 3.10 | 96 | 2212 |
| 47 | 12.0 | 168.0 | 3.15 | 95 | 2271 |
| 48 | 12.0 | 142.4 | 3.15 | 89 | 2480 |
| 50 | 13.5 | 151.0 | 3.15 | 82 | 2631 |
| 55 | 13.6 | 136.0 | 3.22 | 86 | 2549 |
| 56 | 13.8 | 141.6 | 3.00 | 81 | 2664 |
| 58 | 13.6 | 158.4 | 3.00 | 83 | 2506 |
| 61 | 13.5 | 141.6 | 3.02 | 90 | 2499 |
| 62 | 12.0 | 140.0 | 3.05 | 85 | 2458 |
| 64 | 9.6 | 140.0 | 3.05 | 87 | 2374 |
| 66 | 9.0 | 136.0 | 3.10 | 89 | 2326 |
| 68 | 10.0 | 142.0 | 3.12 | 93 | 2238 |
| 70 | 10.5 | 135.3 | 3.15 | 90 | 2387 |
| 72 | 10.5 | 145.0 | 3.15 | 90 | 2387 |
| 74 | 10.0 | 130.0 | 3.15 | 86 | 2503 |
| 80 | 12.0 | 141.0 | 3.13 | 87 | 2464 |
| 84 | 12.0 | 136.0 | 3.15 | 89 | 2426 |
| 88 | 12.0 | 138.5 | 3.10 | 88 | 2452 |

EXAMPLE 2

The procedure of Example 1 was duplicated using a polypropylene felt having a thickness of 0.18 of an inch. After one week of cell operation a mixture of colloidal silica and magnesium chloride in a 10 percent aqueous solution was prepared. The mixture, containing a weight ratio of silica to $MgCl_2$ of 85:15, was added to the anolyte in an amount corresponding to about 3 percent of the volume of the anolyte compartment. The cell was operated for a period of about 3 weeks at a cell voltage of 3.00–3.10 volts, and produced catholyte liquor containing 122–142 grams per liter of NaOH at a cathode current efficiency of 86–92 percent.

EXAMPLE 3

A mixture of colloidal silica and magnesia in sodium chloride brine, having a concentration of 295–305 grams per liter, was prepared. The mixture contained a weight ratio of $SiO_2$ to MgO of 85:15.

A section of polytetrafluoroethylene felt 0.068 of an inch thick was impregnated with this mixture using the procedure of Example 1.

The impregnated diaphragm was installed in a cell similar to that of Example 1 and operated using a brine and conditions identified to those used in Example 1.

What is claimed is:

1. In an electrolytic diaphragm cell for the electrolysis of alkali metal chloride brines having an anode assembly containing a plurality of foraminous metal anodes, a cathode assembly having a plurality of foraminous metal cathodes, a diaphragm covering said cathodes, and a cell body housing said anode assembly and said cathode assembly, the improvement which comprises a porous diaphragm comprising a thermoplastic support fabric impregnated with a non-fibrilic active component containing silica, said porous diaphragm having a permeability to said alkali chloride brines of from about 100 to about 300 milliliters per minute per square meter of said diaphragm at a head level in said cell of from about 0.1 to about 20 inches of said alkali metal chloride brines.

2. A porous diaphragm for an electrolytic cell for the electrolysis of alkali metal chloride brines which comprises a support fabric impregnated with a non-fibrilic active component containing silica, said active component being present at a concentration of from about 10 to about 75 milligrams per square centimeter of support fabric.

3. A porous diaphragm for an electrolytic cell for the electrolysis of alkali metal chloride brines which comprises a thermoplastic support fabric impregnated with a non-fibrilic active component containing silica, said porous diaphragm having a permeability to said alkali metal chloride brines of from about 100 to about 300 milliliters per minute per square meter of said diaphragm at a head level difference in said cell of from about 0.1 to about 20 inches of said alkali metal chloride brines.

4. The porous diaphragm of claim 3 in which said active component containing silica is capable of hydration in contact with an aqueous solution of a salt selected from the group consisting of alkali metal chlorides, alkali metal hydroxides, and mixtures of alkali metal chlorides and alkali metal hydroxides.

5. The porous diaphragm of claim 4 in which said salt is selected from the group consisting of alkali metal hydroxides and mixtures of alkali metal chlorides and alkali metal hydroxides.

6. The porous diaphragm of claim 5 in which said active component containing silica forms a gel in contact with said salt.

7. The porous diaphragm of claim 6 in which said support fabric is a polyolefin selected from the group consisting of olefins having from 2 to about 6 carbon atoms and their chloro- and fluoro- derivatives.

8. The porous diaphragm of claim 7 in which said support fabric is a layered structure having a first layer with a thickness of from 0.09 to about 0.187 of an inch and an air permeability of from about 100 to about 500 cubic feet per minute per square foot of support fabric; and a second layer with a thickness of from about 0.03 to about 0.125 of an inch and an air permeability of from about 1 to about 15 cubic feet per minute.

9. The porous diaphragm of claim 8 in which said first layer and said second layer are comprised of polytetrafluoroethylene.

10. The porous diaphragm of claim 9 in which said second layer is a felt fabric.

11. The porous diaphragm of claim 7 in which said support fabric has a thickness of from about 0.04 to about 0.33 of an inch.

12. The porous diaphragm of claim 11 in which said active component containing silica is selected from the group consisting of sand, quartz, silica sand, colloidal silica, chalcedony, cristobalite and tripolite.

13. The porous diaphragm of claim 12 having an additive containing magnesium selected from the group consisting of magnesia, magnesium acetate, magnesium aluminate, magnesium carbonate, magnesium chloride, magnesium hydroxide, magnesium oxide, magnesium peroxide, magnesium silicate, magnesite, periclase, dolomites and mixtures thereof, said additives being employed in amounts of from about 10 to about 70 percent by weight of said active component containing silica.

14. The porous diaphragm of claim 13 in which said support fabric is a polyolefin compound selected from the group consisting of polytetrafluoroethylene and polyvinylidene fluoride.

15. The porous diaphragm of claim 14 in which said support fabric is a felt fabric having a thickness of from about 0.06 to about 0.25 of an inch.

16. The porous diaphragm of claim 15 in which said active component containing silica is colloidal silica.

17. The porous diaphragm of claim 16 in which said additive is magnesium chloride.

18. The porous diaphragm of claim 17 in which said additive is magnesium oxide.

19. The porous diaphragm of claim 12 having an additive containing aluminum selected from the group consisting of alumina, aluminum acetate, aluminum chlorate, aluminum chloride, aluminum hydroxide, aluminum oxides ($\alpha$, $\beta$ and $\gamma$), aluminum silicate, corundum, bauxites and mixtures thereof, said additive being employed in amounts of from about 10 to about 70 percent by weight of said active component containing silica.

20. The porous diaphragm of claim 11 in which said active component containing silica is an alkali metal silicate.

21. The porous diaphragm of claim 11 in which said active component containing silica is selected from the group consisting of magnesium silicates, sepiolites, meerschaums, augites, talcs, vermiculites, and mixtures thereof.

22. The porous diaphragm of claim 11 in which said active component containing silica is selected from the group consisting of attapulgites, montmorillonites, and bentonites and mixtures thereof.

23. The porous diaphragm of claim 11 in which said active component containing silica is selected from the group consisting of aluminum silicates, albites, feldspars, labradorites, microclines, nephelites, orthoclases, pyrophyllites, and sodalites, and mixtures thereof.

24. The porous diaphragm of claim 11 in which said support fabric has an air permeability of from about 1 to about 500 cubic feet per minute per square foot of support fabric.

25. The porous diaphragm of claim 24 in which said support fabric is a polyolefin selected from the group consisting of polytetrafluoroethylene, fluorinated ethylene-propylene, polychlorotrifluoroethylene, polyvinyl fluoride and polyvinylidene fluoride.

26. The porous diaphragm of claim 25 in which said active component containing silica is selected from the group consisting of magnesium silicates, sepiolites, meerschaums, augites, talcs, vermiculites and mixtures thereof.

27. The porous diaphragm of claim 26 in which said support fabric has a thickness of from about 0.06 to about 0.25 of an inch.

28. The porous diaphragm of claim 27 in which said polyolefin compound is selected from the group consisting of polytetrafluoroethylene and polyvinylidene fluoride.

29. The porous diaphragm of claim 28 in which said active component containing silica is selected from the group consisting of magnesium silicates, sepiolites and meerschaums.

30. The porous diaphragm of claim 29 in which said polyolefin is polytetrafluoroethylene.

31. The porous diaphragm of claim 30 in which said active component containing silica are sepiolites.

32. The porous diaphragm of claim 31 in which said support fabric is a felt fabric.

33. The porous diaphragm of claim 32 in which said active component containing silica is dispersed in said support fabric at a concentration of from about 30 to about 50 milligrams per square centimeter of support fabric.

34. The porous diaphragm of claim 6 in which said support fabric is a polyarylene sulfide selected from the group consisting of polyphenylene sulfide, polynaphthalene sulfide, poly(perfluorophenylene) sulfide, and poly(methylphenylene) sulfide.

35. The porous diaphragm of claim 34 in which said active component containing silica is selected from the group consisting of sand, quartz, silica sand, colloidal silica, chalcedony, cristobalite and tripolite.

36. The porous diaphragm of claim 35 having an additive containing magnesium selected from the group consisting of magnesia, magnesium acetate, magnesium aluminate, magnesium carbonate, mangesium chloride, magnesium hydroxide, magnesium oxide, magnesium peroxide, magnesium silicate, magnesite, periclase, dolomites and mixtures thereof, said additives being employed in amounts of from about 10 to about 70 percent by weight of said active component containing silica.

37. The porous diaphragm of claim 36 in which said support fabric has an air permeability of from about 1 to about 500 cubic feet per minute per square foot of support fabric.

38. The porous diaphragm of claim 37 in which said support fabric has a thickness of from about 0.04 to about 0.33 of an inch.

39. The porous diaphragm of claim 38 in which said support fabric is polyphenylene sulfide.

40. The porous diaphragm of claim 39 in which said active component containing silica is selected from the group consisting of magnesium silicates, sepiolites and meerschaums.

41. The porous diaphragm of claim 40 in which said support fabric is a felt fabric.

42. The porous diaphragm of claim 41 in which said active component is dispersed in said support fabric at a concentration of from about 30 to about 50 milligrams per square centimeter of support fabric.

43. The porous diaphragm of claim 35 having an additive containing aluminum selected from the group consisting of alumina, aluminum acetate, aluminum chlorate, aluminum chloride, aluminum hydroxide, aluminum oxides ($\alpha$, $\beta$ and $\gamma$), aluminum silicate, corundum, bauxites and mixtures thereof, said additives being employed in amounts of from about 10 to about 70 percent by weight of said active component containing silica.

44. The porous diaphragm of claim 34 in which said active component containing silica is an alkali metal silicate.

45. The porous diaphragm of claim 34 in which said active component containing silica is selected from the group consisting of magnesium silicates, sepiolites, meerschaums, augites, talcs, vermiculites and mixtures thereof.

46. The porous diaphragm of claim 34 in which said active component containing silica is selected from the group consisting of attapulgites, montmorillonites and bentonites and mixtures thereof.

47. The porous diaphragm of claim 34 in which said active component containing silica is selected from the group consisting of aluminum silicates, albites, feldspars, labradorites, microclines, nephelites, orthoclases, pyrophyllites, and sodalites and mixtures thereof.

* * * * *